United States Patent [19]

Johnson

[11] 4,218,081

[45] Aug. 19, 1980

[54] LATCH WITH MULTIPLE FUNCTION PREVAILING-TORQUE MECHANISM

[75] Inventor: Norman S. Johnson, New Milford, N.J.

[73] Assignee: United Products Inc., South Hackensack, N.J.

[21] Appl. No.: 962,330

[22] Filed: Nov. 20, 1978

[51] Int. Cl.[2] ..... E05C 5/02

[52] U.S. Cl. ..... 292/66; 292/DIG. 49

[58] Field of Search ..... 292/63, 64, 65, 66, 292/247, 113, DIG. 49, 103

[56] References Cited

U.S. PATENT DOCUMENTS

| | | | |
|---|---|---|---|
| 2,462,282 | 2/1949 | Pickford | 292/247 X |
| 3,237,978 | 3/1966 | Swanson | 292/247 X |
| 3,954,293 | 5/1976 | Orr | 292/113 X |

FOREIGN PATENT DOCUMENTS

| | | | |
|---|---|---|---|
| 516922 | 1/1940 | United Kingdom | 292/103 |

*Primary Examiner*—Richard E. Moore

*Attorney, Agent, or Firm*—Samuelson & Jacob

[57] ABSTRACT

A latch having a multiple function prevailing-torque mechanism which facilitates engagement and disengagement of the drawbolt and the strike of the latch and provides a simplified construction enabling ease of assembly and adjustment, with the prevailing-torque mechanism serving to retain the component parts in assembled arrangement and in appropriate adjustment. A further latch arrangement includes a positive lock which serves to retain the actuating lever of the latch in a stowed or latched location.

19 Claims, 12 Drawing Figures

LATCH WITH MULTIPLE FUNCTION PREVAILING-TORQUE MECHANISM

The present invention relates generally to latches and pertains, more specifically, to latch constructions of the type usually employed in securing together selectively separable first and second parts, such as a container and a container cover.

A wide variety of latches currently are available for use in securing together parts which must be separated readily whenever desired. The continuing growth in the production and use of large containers for storage and transportation has led to an increased demand for larger, more rugged latches used in connection with such containers to secure together various parts of the containers. However, increasing costs of materials and manufacture make it desirable to have available a latch which is simple in design and construction, yet is rugged enough to withstand the rigors of use so as to provide a long service life. In addition, ease of operation by unskilled operators would be an asset for a latch employed in such environments.

It is an object of the present invention to provide a latch which is simple in construction, yet rugged enough to withstand rigorous use over a long service life.

Another object of the invention is to provide a latch having a minimum number of component parts, each having a simplified construction, and all being assembled with ease so as to facilitate not only initial manufacture, but the replacement of damaged component parts in the field.

Still another object of the invention is to provide a latch in which a prevailing-torque mechanism facilitates operation of the latch.

Yet another object of the invention is to provide a latch in which a prevailing-torque mechanism serves to enable ease of adjustment of the drawbolt of the latch while further facilitating assembly or dismantling of the latch for installation or repair in the field.

A further object of the invention is to provide a latch construction which is exceptionally versatile and finds a wide variety of applications.

A still further object of the invention is to provide a latch with a positive locking arrangement which enables increased flexibility of use without complex operation.

Another object of the invention is to provide a latch which is retained in a compact, stowed configuration when not in use, and is thereby less susceptible to damage.

Yet another object of the invention is to provide a latch which is economical to fabricate in large numbers of uniform high quality.

The above objects, as well as still further objects and advantages, are attained by the present invention which may be described briefly as a latch of the type having a latch member to be carried by a first part and a strike to be carried by a second part for latching engagement with the latch member to secure together the first and second parts, the latch comprising: a latch base; means for affixing the latch base to the first part; an actuating lever; means for mounting the actuating lever on the latch base for pivotal movement between first and second locations relative to the latch base; a drawbolt; means for mounting the drawbolt on the actuating lever for swinging movement relative to the actuating lever between a first position, wherein the drawbolt is positioned relative to the actuating lever for latching engagement with the strike when the actuating lever is in the first location, and a second position, wherein the drawbolt is positioned relative to the actuating lever for disengagement from the strike when the actuating lever is in the second location, and away from the strike when the actuating lever is in the first location; prevailing-torque means between the drawbolt and the actuating lever for holding the drawbolt against swinging movement relative to the actuating lever such that swinging movement between the first and second positions will be enabled only upon overcoming a given prevailing torque, whereby pivotal movement of the actuating lever from the first location to the second location when the drawbolt is engaged with the strike will enable movement of the drawbolt relative to the actuating lever from the first position to the second position, against the given prevailing torque, and pivotal movement of the actuating lever from the second location toward the first location, with the drawbolt held in the second position by the prevailing-torque means, will withdraw the drawbolt from the strike.

In addition, the invention can include positive locking means having at least one locking pin mounted upon the actuating lever for movement between a locking position and a release position, and a locking shoulder on the latch base for engaging the locking pin, when the actuating lever is in the first location and the locking pin is in the locking position, to lock the actuating lever in the first location; and release means including a release lever, means mounting the release lever upon the actuating lever for movement relative thereto between a lock location and a release location, and means coupling the release lever with the locking pin and the actuating lever such that movement of the release lever in the direction toward the release location will release the locking pin from engagement with the locking shoulder and continued movement in that same direction will move the actuating lever from the first location toward the second location thereof.

The invention will be more fully understood, while still further objects and advantages will become apparent, in the following detailed description of preferred embodiments of the invention illustrated in the accompanying drawing, in which.

Figures 1, 2:
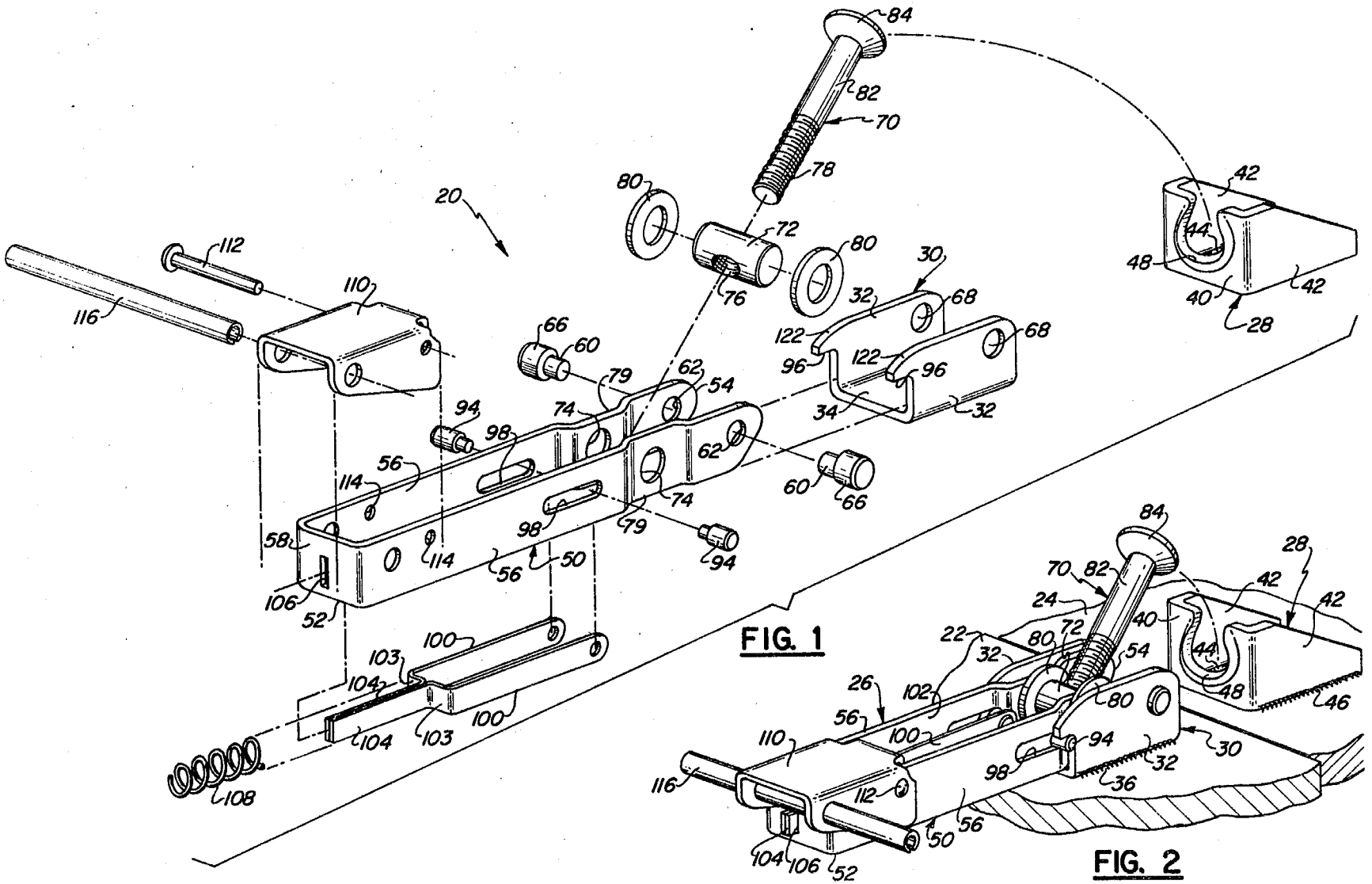
FIG. 1 is an exploded perspective view of a latch constructed in accordance with the invention.
FIG. 2 is a perspective view of the latch of FIG. 1, assembled, but unlatched.

Referring now to the drawing, and especially to FIGS. 1 and 2 thereof, a latch constructed in accordance with the invention is shown at 20. Latch 20 is to be used to secure together first and second parts 22 and 24, respectively, such as a container and a container cover, and includes a latch member 26 which will be carried by the first part 22 and a strike 28 which will be carried by the second part 24.

Latch member 26 has a latch base 30 which includes a pair of upstanding, parallel side walls 32 and an interconnecting basal web 34 resting upon first part 22. Basal web 34 provides means for affixing the latch member 26 to the first part 22 and thus may be secured to first part 22 in any one of several ways, as, for example, by welds, rivets, threaded fasteners, adhesives or the like. In this instance, welds 36 are employed to affix latch base 30 to the first part 22, with the welds 36 running along the intersections of side walls 32 with basal web 34.

Strike 28 has an upstanding front wall 40 and includes a pair of upstanding parallel side walls 42 and an interconnecting basal web 44 which rests upon second part 24. Basal web 44 may be secured to second part 24 in one of several alternate ways such as by welds, rivets, threaded fasteners, adhesives or the like. Again, in this instance, welds 46 are employed to secure strike 28 to the second part 24, with welds 46 running along the intersections of side walls 42 with basal web 44. A slot 48 is provided in the front wall 40 for purposes which will be set forth below.

Latch member 26 includes an actuating lever 50 which extends longitudinally between a first end 52 and a second end 54 and has a pair of longitudinally extending lever arms 56 which are generally parallel to one another and are interconnected at first end 52 by a transverse wall 58. Thus, actuating lever 50 is constructed in a unitary structure formed of a single piece of metal, such as steel.

Figure 3:
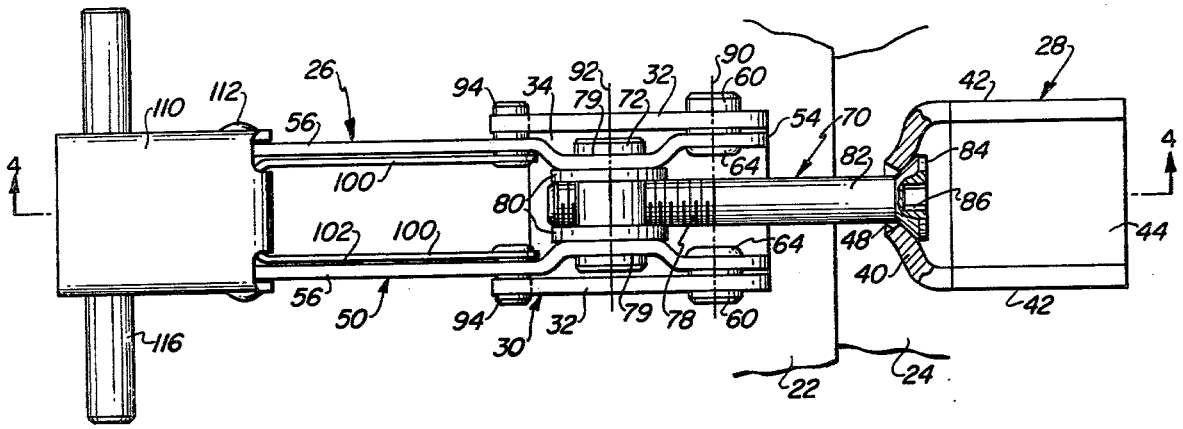
FIG. 3 is a top plan view of the latch in latched condition.

A pair of pivot pins 60 are received within complementary apertures 62 located adjacent the second end 54 of actuating lever 50 and are secured to the actuating lever 50, as by heading each pivot pin 60 at 64 (see FIG. 3). Pivot pins 60 each have a bearing surface 66 which is journalled within a complementary opening 68 in each side wall 32 of the latch base 30 to serve as means for mounting the actuating lever 50 on the latch base 30 for pivotal movement relative thereto.

A drawbolt 70 is mounted on the actuating lever 50, for swinging movement relative to the actuating lever 50, by means of a laterally extending shaft 72 journalled within opposed openings 74 in the lever arms 56 of the actuating lever 50 and having a threaded aperture 76 therein for receiving a threaded portion 78 of the drawbolt 70. Openings 74 are located within inwardly-spaced portions 79 of the lever arms 56 so that the ends of shaft 72 do not project laterally beyond the remaining portions of the lever arms 56, for purposes which will be described in further detail hereinafter. A pair of washers 80 is placed upon shaft 72 with one washer 80 at each side of the drawbolt 70. Washers 80 are formed of a material having sufficient resilience to enable the washers 80 to frictionally grip the shaft 72 to retain the shaft 72 within openings 74, while at the same time being compressed slightly between drawbolt 70 and portions 79 of lever arms 56. In addition, the material of washers 80 has sufficient renitence to engender frictional forces between the washers 80 and the respective portions 79 of lever arms 56, and between the washers 80 and the drawbolt 70 to establish prevailing-torque means for holding the drawbolt 70 against swinging movement relative to the actuating lever 50 so that such swinging movement will be enabled only upon overcoming a prevailing torque, as established by the properties of the material of washers 80. One such material for washers 80 is nylon, and other materials will become apparent to those skilled in the art of materials.

Figure 4:
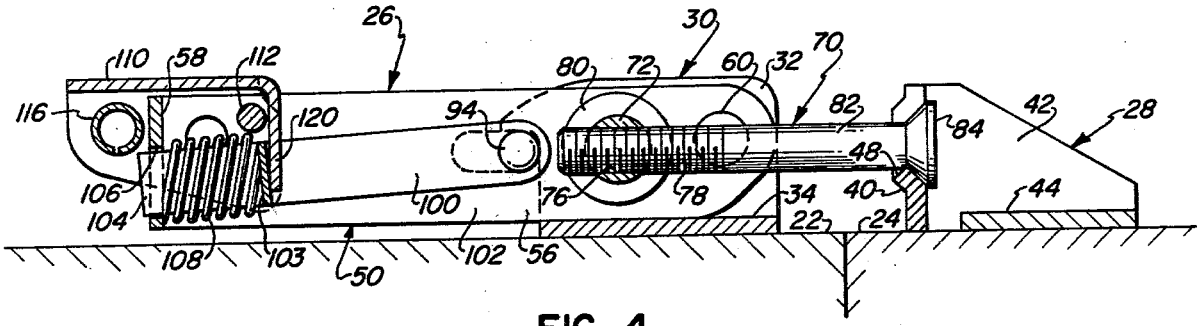
FIG. 4 is a longitudinal cross-sectional view taken along line 4—4 of FIG. 3.
Figure 5:
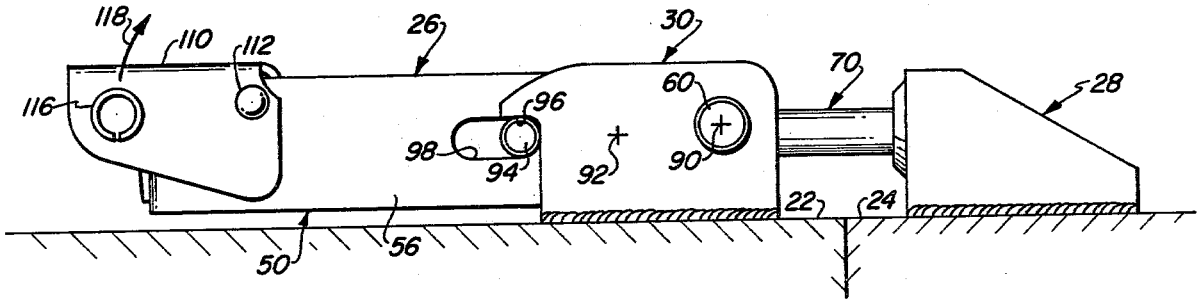
FIGS. 5 through 8 are side elevational views of the latch in various operating positions.

Drawbolt 70 includes a shank 82 which carries threaded portion 78 and a head 84 which is received within slot 48 of the strike 28 for latching purposes. As seen in FIGS. 3, 4 and 5, head 84 is placed within slot 48 and the latch 20 is in latched condition, securing together first and second parts 22 and 24. The actuating lever 50 is in a first location wherein the actuating lever extends along the first part 22 in close proximity thereto, while the position of the drawbolt 70 relative to the actuating lever 50 is such that the drawbolt is engaged within the slot 48 of the strike 28. It is noted that drawbolt 70 has the configuration of a standard, commercially available bolt, rendering the drawbolt an economical component of the entire assembly and one which is interchangeable to attain different lengths and for ready replacement as required. A wrenching socket 86 within head 84 enables ease in turning the drawbolt 70 for selective adjustment of the length thereof so that appropriate tension is achieved when the latch 20 is in latched condition. Such an adjustment may be effected even while the latch 20 is in the latched condition, enabling the desired secured relationship between parts 22 and 24. The adjusted position of drawbolt 70 within shaft 72 is maintained by the prevailing torque established by washers 80 acting against the threaded portion 78 of drawbolt 70.

Figure 6:
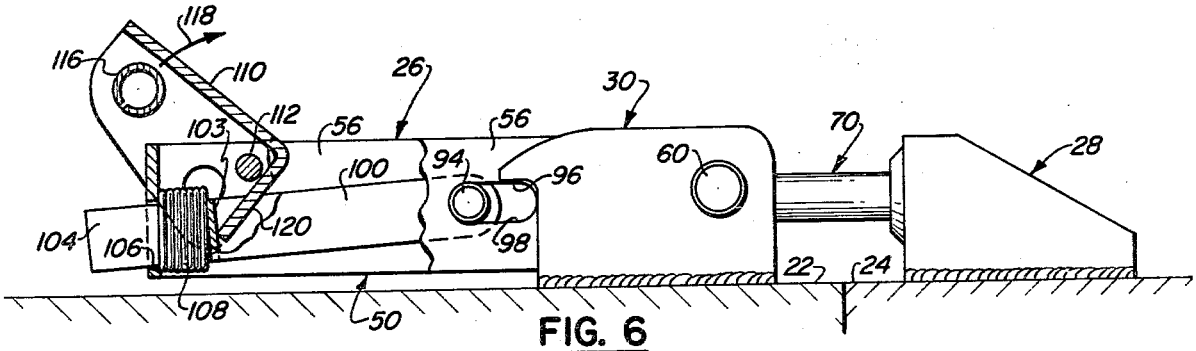

Turning now to FIGS. 4, 5 and 6, as well as to FIGS. 1, 2 and 3, latch 20 is maintained in the latched condition by virtue of an over-center locking relationship between the pivotal axis 90 of the actuating lever 50 and the swing axis 92 of the drawbolt 70. Thus, in the latched condition, with the actuating lever 50 in the latched location, the swing axis 92 lies between the pivotal axis 90 and the basal web 34 and the actuating lever 50 is biased toward the latched location. However, in addition to the over-center locking arrangement, latch 20 is provided with positive locking means shown in the form of locking pins 94 carried by the actuating lever 50 and engaging locking shoulders 96 on the side walls 32 of the latch base 30. Locking pins 94 pass through elongate slots 98 in lever arms 56 and are affixed to locking brackets 100 located within a cage 102 established by the lever arms 56 and transverse wall 58 of the actuating lever 50. Each locking bracket 100 has a seat 103 and a tongue 104. Tongues 104 extend through a complementary slit 106 in transverse wall 58. A helical spring 108 is located between the transverse wall 58 and seats 103 and biases the locking brackets 100 and the locking pins 94 toward the locking position illustrated in FIGS. 2 through 5.

A release lever 110 is mounted for pivotal movement upon actuating lever 50, adjacent the first end 52, by means of an axle 112 which passes through holes 114 in lever arms 56. A release handle 116 is carried by release lever 110. When the release lever 110 is in the lock location, as seen in FIGS. 4 and 5, the helical spring 108 urges the locking pins 94 into locking position beneath shoulders 96. When it is desired to unlock and unlatch the latch 20, the operator grasps release handle 116 and moves the release lever 110 in the direction of the arrow 118 to raise the release handle 116 toward the release position illustrated in FIG. 6. A finger 120 carried by the release lever 110 thus is urged against the seats 103 of the locking brackets 100 and urges the locking brackets and the locking pins 94, against the bias of helical spring 108, into a release position, as illustrated in FIG. 6, where the locking pins 94 are released from beneath shoulders 96.

Figure 7:
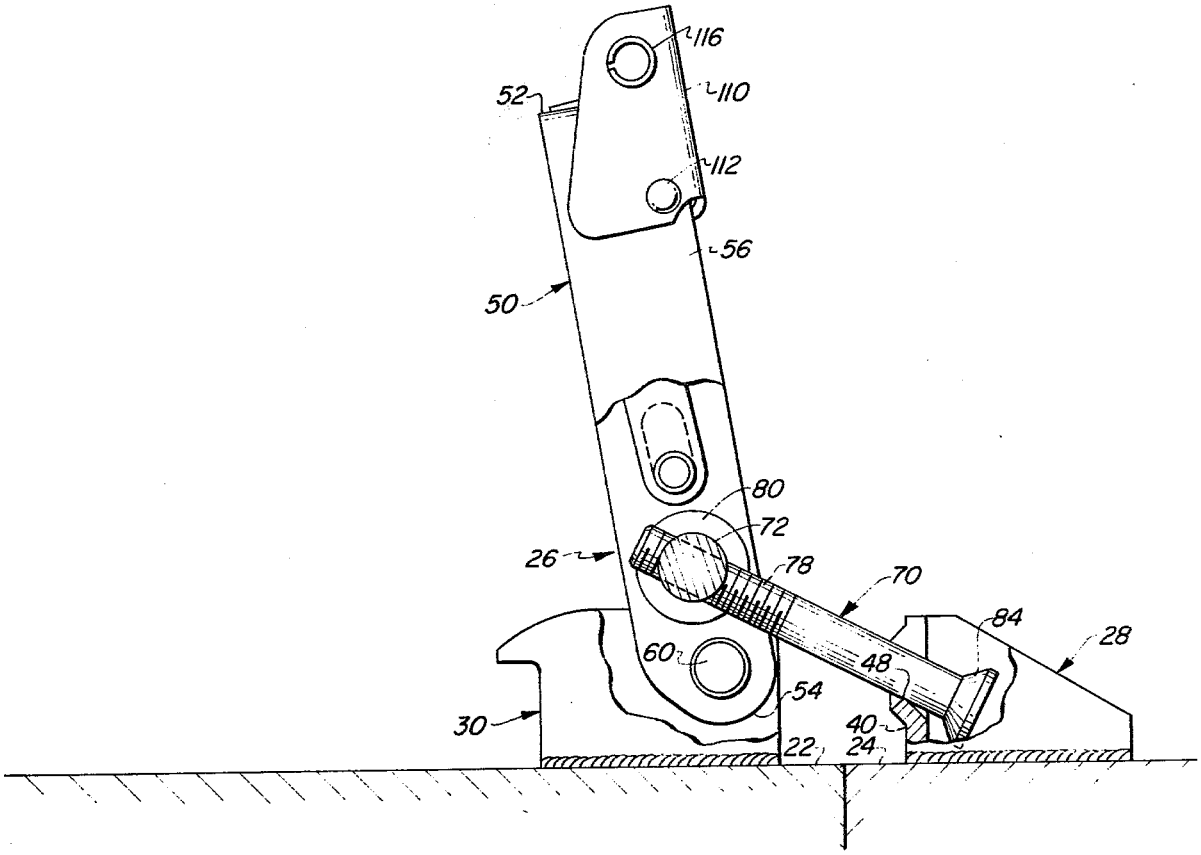

Referring now to FIG. 7, continued movement of release handle 116 in the direction of arrow 118 will pivot the actuating lever 50 from the latched location to the unlatched location shown in FIG. 7. At the same time, drawbolt 70 will swing relative to the actuating lever 50 from the first position, shown in FIGS. 2 through 6, to a second position shown in FIG. 7. It is noted that the drawbolt 70 is supported by the strike 28 while the actuating lever 50 is moved to the unlatched location with a force sufficient to overcome the prevailing torque exerted by washers 80.

Figure 8:
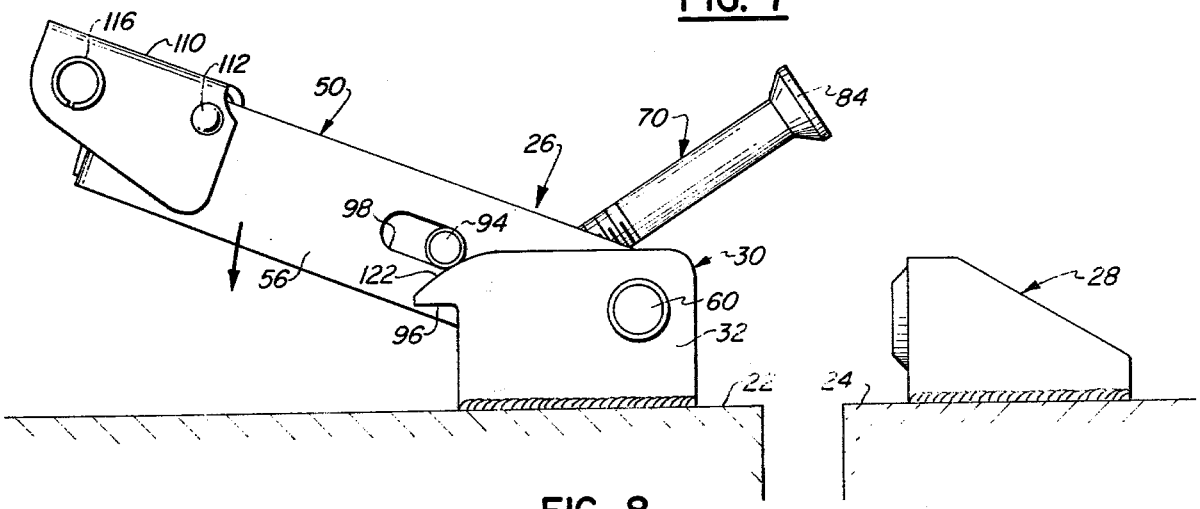
Figure 9:
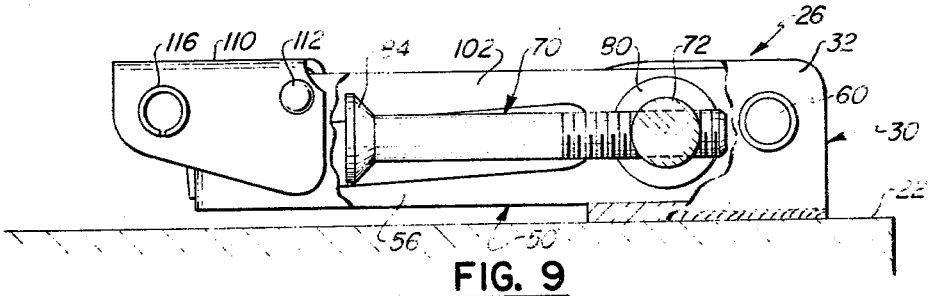
FIG. 9 is a side elevational view of the latch in a stowed configuration.

Turning now to FIG. 8, as well as to FIG. 2, upon return of the actuating lever 50 toward the first location (illustrated in FIG. 2), drawbolt 70 will remain in the second position, relative to the actuating lever 50, by virtue of the prevailing torque exerted by washers 80 upon the drawbolt 70, and the drawbolt 70 will be disengaged from the strike 28. Parts 22 and 24 can then be separated. Continued movement of the actuating lever 50 to the first location will bring the locking pins 94 into contact with cam surfaces 122 on side walls 32 of latch base 30, driving the locking pins 94 against the biasing force of helical spring 108 and enabling complete return of the actuating lever 50 to the first position. Upon such return, the locking pins 94 once again will be urged into locking position beneath shoulders 96 and the actuating lever 50 will be retained in the first location so as to be stowed in a positively locked protected location. As seen in FIG. 9, when the actuating lever 50 is in the stowed condition, the drawbolt 70 may be placed in its stowed position within the cage 102 established between the lever arms 56. The prevailing torque provided by washers 80 will retain the drawbolt 70 in the protected, stowed position. Thus, neither the actuating lever 50 nor the drawbolt 70 will protrude from the first part 22 and potential damage to the latch assembly is minimized. In addition, the ends of shaft 72 are nested between side walls 32 of the latch base 30 to further secure the component parts in their assembled relationship.

Figure 10:
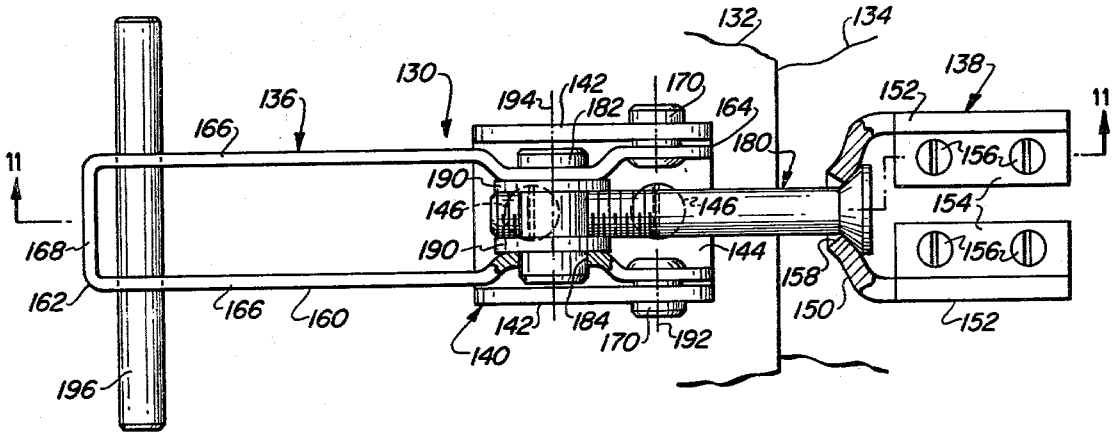
FIG. 10 is a top plan view of another latch constructed in accordance with the invention.
Figure 11:
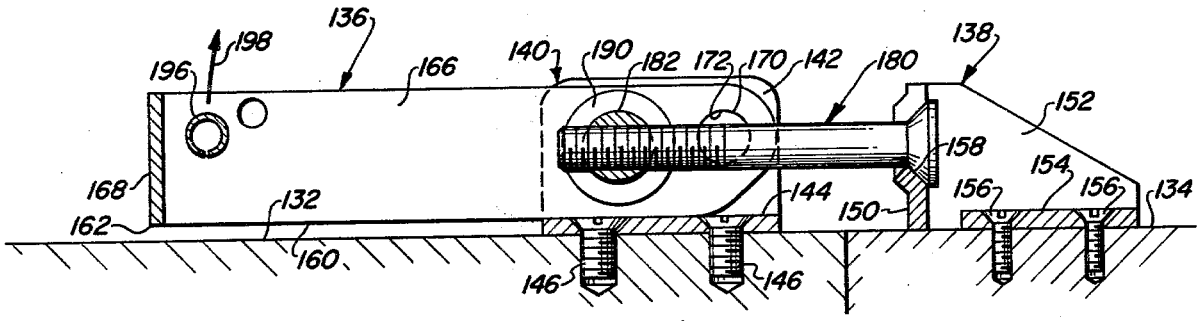
FIG. 11 is a longitudinal cross-sectional view taken along line 11—11 of FIG. 10.
Figure 12:
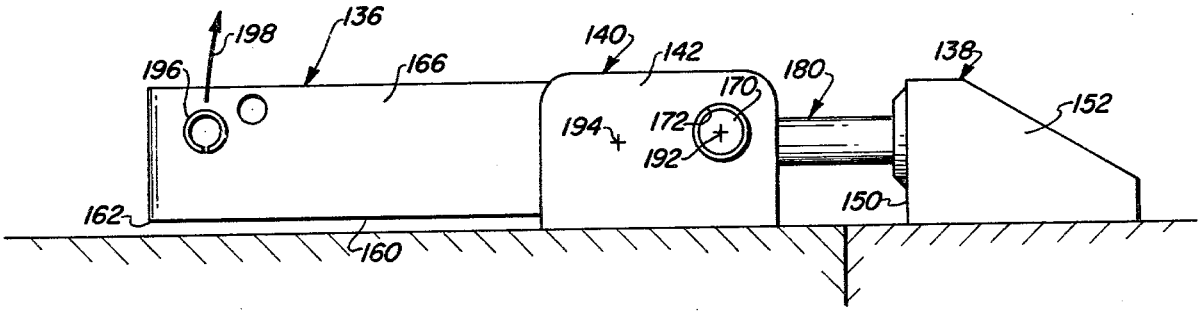
FIG. 12 is a side elevational view of the latch of FIG. 10.

Referring now to FIGS. 10 through 12, another latch constructed in accordance with the invention is illustrated at 130. The component parts of latch 130 are largely the same as the corresponding parts of the earlier-described latch 20, with some exceptions. Whereas latch 20 has a positive locking feature operated by a release lever, latch 130 relies solely upon an over-center locking arrangement and includes no such positive locking feature. Thus, latch 130 is to be used to secure together first and second parts 132 and 134 and includes a latch member 136 carried by the first part 132 and a strike 138 carried by the second part 134. Latch member 136 has a latch base 140 which includes a pair of side walls 142 and a basal web 144 affixed to the first part 132 by means of threaded fasteners 146. Strike 138 has a front wall 150, side walls 152 and basal feet 154 secured to second part 134 by threaded fasteners 156. A slot 158 is provided in the front wall.

Latch member 136 includes an actuating lever 160 which is identical in construction to actuating lever 50 of the earlier-described embodiment and extends between a first end 162 and a second end 164. A pair of longitudinally extending parallel lever arms 166 are connected at a transverse wall 168 and carry a pair of pivot pins 170 journalled in complementary apertures 172 in the side walls 142 of the latch base 140.

A drawbolt 180 is mounted for swinging movement relative to the actuating lever 160 by means of a transverse shaft 182 journalled within openings 184 in the lever arms 166 and retained therein by resilient washers 190, the drawbolt 180, shaft 182 and washers 190 all being identical to the corresponding assembly in earlier-described latch 20. Thus, washers 190 establish a prevailing-torque mechanism for holding the drawbolt 180 in various positions relative to the actuating lever 160 and for securing the adjustment of the length of drawbolt 180 relative to shaft 182.

In the latched condition illustrated in FIGS. 10, 11 and 12, the actuating lever 160 is retained in the latched location by means of an over-center locking mechanism attained by the relative location of pivotal axis 192 of the actuating lever 160 and the swing axis 194 of the drawbolt 180. Hence, in the latched condition, the swing axis 194 lies between the pivotal axis 192 and the basal web 144 so that the actuating lever 160 is biased toward the latched location. In order to unlatch the latch 130, an operator need merely grasp the operating handle 196 and pull upwardly, in the direction of arrow 198, to overcome the over-center locking mechanism and then release the drawbolt 180 from the slot 158 in strike 138, as described in connection with latch 20.

It will be noted that either of the above-described latches are not only easy to operate, but are assembled or dismantled readily in the field for use or for maintenance. Thus, the drawbolts are standard machine bolts which are readily obtainable and easy to replace or adjust by virtue of the threaded connection with the lateral shaft which mounts the drawbolt within the actuating lever. The lateral shaft is easily removed from the actuating lever without special tools by virtue of the resilient washers. The pivotal connection between the actuating lever and the latch base is easily dismantled by pressing the lever arms toward one another, until the pivot pins are released from the apertures in the side walls of the latch base, and assembly is facilitated by allowing the lever arms to spring apart and seat the pivot pins within the apertures in the side walls of the latch base. The positive locking mechanism may be placed at the end of the actuating lever for the embodiment of FIGS. 1 through 9, or may be deleted for the embodiment of FIGS. 10 through 12. Thus, the present invention provides a versatile, rugged arrangement for latches which can be adapted to a wide variety of uses and which will provide exemplary service over a long life. The component parts are simple in design and construction and are economical to fabricate and easy to assemble or dismantle. The latches themselves are easy to operate and to adjust for optimum performance.

It is to be understood that the above detailed description of preferred embodiments of the invention are provided by way of example only. Various details of design and construction may be modified without departing from the true spirit and scope of the invention, as set forth in the appended claims.

The embodiments of the invention in which an exclusive property or privilege is claimed are defined as follows:

1. A latch of the type having a latch member to be carried by a first part and a strike to be carried by a second part for latching engagement with the latch member to secure together the first and second parts, said latch comprising:

a latch base;

means for affixing the latch base to the first part:

an actuating lever including a pair of lever arms extending longitudinally generally parallel to one another and spaced apart laterally;

means for mounting the actuating lever on the latch base for pivotal movement between first and second locations relative to the latch base;

a drawbolt;

means for mounting the drawbolt on the actuating lever for swinging movement relative to the actuating lever between a first position, wherein the drawbolt is positioned relative to the actuating lever for latching engagement with the strike when the actuating lever is in the first location, and a second position, wherein the drawbolt is positioned relative to the actuating lever for disengagement from the strike when the actuating lever is in the second location and away from the strike when the actuating lever is in the first location, the means for mounting the drawbolt on the actuating lever including a shaft extending laterally between the lever arms and journalled for rotation therein, the shaft including a threaded aperture, the drawbolt being carried by the shaft, the drawbolt extending longitudinally from the shaft and being spaced laterally from at least one lever arm, the drawbolt including a threaded portion engaged in the threaded aperture for selective longitudinal movement of the drawbolt relative to the shaft; and prevailing-torque means between the drawbolt and the actuating lever for holding the drawbolt against swinging movement relative to the actuating lever such that swinging movement between the first and second positions will be enabled only upon overcoming a given prevailing torque, the prevailing-torque means including at least one friction element located on the shaft between the drawbolt and the one lever arm for exerting a frictional force to establish the given prevailing torque, whereby pivotal movement of the actuating lever from the first location to the second location when the drawbolt is engaged with the strike will enable movement of the drawbolt relative to the actuating lever from the first position to the second position, against the given prevailing torque, and pivotal movement of the actuating lever from the second location toward the first location, with the drawbolt held in the second position by the prevailing-torque means, will withdraw the drawbolt from the strike, the friction element engaging the drawbolt to establish a further prevailing torque tending to retain the drawbolt in a selected longitudinal position relative to the shaft.

2. The invention of claim 1 wherein:

the drawbolt is spaced laterally from both lever arms; and a friction element is located on the shaft between the drawbolt and each lever arm.

3. The invention of claim 2 wherein each friction element engages the shaft in removable frictional engagement therewith to retain the shaft in selectively removable assembled relationship with the lever.

4. The invention of claim 1 or 3 wherein each friction element comprises an annular member of resilient material.

5. The invention of claim 1 or 3 wherein the drawbolt is movable to a third position relative to the actuating lever, wherein the drawbolt lies between the lever arms and in parallel longitudinal alignment therewith, the prevailing-torque means holding the drawbolt in said third position.

6. The invention of claim 1 or 3 wherein:

the latch base includes a pair of side walls spaced apart laterally for juxtaposition with the lever arms;

the means for mounting the actuating lever on the latch base includes a pair of pivot pins extending laterally for pivotally connecting each lever arm with a corresponding juxtaposed side wall; and the lever arms are selectively movable laterally relative to one another to disengage the pivotal connection between each lever arm and the corresponding side wall.

7. The invention of claim 5 wherein the lever arms are located between the side walls.

8. A latch of the type having a latch member to be carried by a first part and a strike to be carried by a second part for latching engagement with the latch member to secure together the first and second parts, said latch comprising:

a latch base;

means for affixing the latch base to the first part;

an actuating lever;

means for mounting the actuating lever on the latch base for pivotal movement between first and second locations relative to the latch base;

positive locking means on the actuating lever and the latch base for locking the actuating lever to the latch base in the first location, the positive locking means including at least one locking pin mounted upon the actuating lever for movement between a locking position and a release position, and a locking shoulder on the latch base for engaging the locking pin, when the actuating lever is in the first location and the locking pin is in the locking position, to lock the actuating lever in the first location;

release means carried by the actuating lever for selectively releasing the actuating lever from the latch base, the release means including a release lever, means mounting the release lever upon the actuating lever for movement relative thereto between a lock location and a release location, and means coupling the release lever with the locking pin and the actuating lever such that movement of the release lever in the direction toward the release location will release the locking pin from engagement with the locking shoulder and continued movement in said direction will move the actuating lever from the first location toward the second location thereof;

a drawbolt;

means for mounting the drawbolt on the actuating lever for swinging movement relative to the actuating lever between a first position, wherein the drawbolt is positioned relative to the actuating lever for latching engagement with the strike when the actuating lever is in the first location, and a second position, wherein the drawbolt is positioned relative to the actuating lever for disengagement from the strike when the actuating lever is in the second location and away from the strike when the actuating lever is in the first location; and prevailing-torque means between the drawbolt and the actuating lever for holding the drawbolt against swinging movement relative to the actuating lever such that swinging movement between the first and second positions will be enabled only upon overcoming a given prevailing torque, whereby pivotal movement of the actuating lever from the first location to the second location when the drawbolt is engaged with the strike will enable movement of the drawbolt relative to the actuating lever from the first position to the second position, against the given prevailing torque, and pivotal movement of the actuating lever from the second location toward the first location, with the drawbolt held in the second position by the prevailing-torque means, will withdraw the drawbolt from the strike.

9. The invention of claim 8 wherein:

the positive locking means includes means resiliently biasing the locking pin toward the locking position and a cam surface on the latch base for urging the locking pin toward the release position, in response to movement of the actuating lever toward the first location, and enabling the resilient biasing means to urge the locking pin into the locking position upon the arrival of the actuating lever at the first location.

10. The invention of claim 9 wherein:

the actuating lever includes a pair of lever arms extending longitudinally parallel to one another and spaced apart laterally;

the latch base includes a pair of side walls spaced apart laterally for juxtaposition with the lever arms;

the means for mounting the actuating lever on the latch base includes a pair of pivot pins extending laterally for pivotally connecting each lever arm with a corresponding juxtaposed side wall;

the positive locking means includes a locking pin extending laterally from each lever arm, a locking shoulder on each side wall for engaging a corresponding locking pin and a cam surface on each side wall for urging each locking pin toward the release position.

11. The invention of claim 10 including an actuating handle on the release lever for enabling grasping by an operator to actuate the latch.

12. The invention of claim 8, 9 or 10 wherein the relative location of the means for mounting the actuating lever on the latch base and the means for mounting the drawbolt on the actuating lever establishes an over-center locking action when the actuating lever is in the first location and the drawbolt is in the first position.

13. A latch of the type having a latch member to be carried by a first part and a strike to be carried by a second part for latching engagement with the latch member to secure together the first and second parts, said latch comprising:

a latch base;

means for affixing the latch base to the first part;

an actuating lever;

means for mounting the actuating lever on the latch base for pivotal movement between first and second locations relative to the latch base;

a drawbolt;

means for mounting the drawbolt on the actuating lever for swinging movement relative to the actuating lever;

positive locking means including at least one locking pin mounted upon the actuating lever for movement between a locking position and a release position, and a locking shoulder on the latch base for engaging the locking pin, when the actuating lever is in the first location and the locking pin is in the locking position, to lock the actuating lever in the first location; and release means including a release lever, means mounting the release lever upon the actuating lever for movement relative thereto between a lock location and a release location, and means coupling the release lever with the locking pin and the actuating lever such that movement of the release lever in the direction toward the release location will release the locking pin from engagement with the locking shoulder and continued movement in said direction will move the actuating lever from the first location toward the second location thereof.

14. The invention of claim 13 wherein the positive locking means includes means resiliently biasing the locking pin toward the locking position and a cam surface on the latch base for urging the locking pin toward the release position, in response to movement of the actuating lever toward the first location, and enabling the resilient biasing means to urge the locking pin into the locking position upon the arrival of the actuating lever at the first location.

15. The invention of claim 14 wherein:

the actuating lever includes a pair of lever arms extending longitudinally parallel to one another and spaced apart laterally;

the latch base includes a pair of side walls spaced apart laterally for juxtaposition with the lever arms;

the means for mounting the actuating lever on the latch base includes a pair of pivot pins extending laterally for pivotally connecting each lever arm with a corresponding juxtaposed side wall; and the positive locking means includes a locking pin extending laterally from each lever arm, a locking shoulder on each side wall for engaging a corresponding locking pin and a cam surface on each side wall for urging each locking pin toward the release position.

16. The invention of claim 15 including an actuating handle on the release lever for enabling grasping by an operator to actuate the latch.

17. The invention of claim 13, 14, 15 or 16 wherein the relative location of the means for mounting the actuating lever on the latch base and the means for mounting the drawbolt on the actuating lever establishes an over-center locking action when the actuating lever is in the first location.

18. A latch of the type having a latch member to be carried by a first part and a strike to be carried by a second part for latching engagement with the latch member to secure together the first and second parts, said latch comprising:

a latch base;

means for affixing the latch base to the first part;

an actuating lever including a pair of lever arms extending longitudinally generally parallel to one another and spaced apart laterally;

means for mounting the actuating lever on the latch base for pivotal movement between first and second locations relative to the latch base;

a drawbolt;

means for mounting the drawbolt on the actuating lever for swinging movement relative to the actuating lever between a first position, wherein the drawbolt is positioned relative to the actuating lever for latching engagement with the strike when the actuating lever is in the first location, and a second position, wherein the drawbolt is positioned relative to the actuating lever for disengagement from the strike when the actuating lever is in the second location and away from the strike when the actuating lever is in the first location, the means for mounting the drawbolt on the actuating lever including a shaft extending laterally between the lever arms and journalled for rotation therein, the drawbolt being carried by the shaft; and prevailing-torque means between the drawbolt and the actuating lever for holding the drawbolt against swinging movement relative to the actuating lever such that swinging movement between the first and second positions will be enabled only upon overcoming a given prevailing torque, the prevailing-torque means including at least one friction element for exerting a frictional force to establish the given prevailing torque, whereby pivotal movement of the actuating lever from the first location to the second location, when the drawbolt is engaged with the strike, will enable movement of the drawbolt relative to the actuating lever from the first position to the second position, against the given prevailing torque, and pivotal movement of the actuating lever from the second location toward the first location, with the drawbolt held in the second position by the prevailing-torque means, will withdraw the drawbolt from the strike;

the drawbolt being movable to a third position relative to the actuating lever, wherein the drawbolt lies between the lever arms and in parallel longitudinal alignment therewith, the prevailing-torque means holding the drawbolt in said third position.

19. The invention of claim 18 wherein the lever arms are located between the side walls.

* * * * *